US006033348A

United States Patent [19]

Warshauer

[11] Patent Number: 6,033,348

[45] Date of Patent: Mar. 7, 2000

[54] MARTIAL ARTS PRACTICE DEVICE

[76] Inventor: Matthew S. Warshauer, 1021 Farmington Ave., West Hartford, Conn. 06107

[21] Appl. No.: 09/130,119

[22] Filed: Aug. 6, 1998

[51] Int. Cl.[7] ..... A63B 67/00

[52] U.S. Cl. ..... 482/83; 482/83; 482/87; 482/90

[58] Field of Search ..... 482/83–90; 473/441–445

[56] References Cited

U.S. PATENT DOCUMENTS

| | | | |
|---|---|---|---|
| 72,941 | 12/1867 | Vose . | |
| 419,285 | 1/1890 | Sanborn . | |
| 658,554 | 9/1900 | McFadden . | |
| 925,342 | 6/1909 | Johnson . | |
| 1,032,454 | 7/1912 | Wainwright . | |
| 1,679,174 | 7/1928 | Richards et al. . | |
| 1,733,709 | 10/1929 | Zinnow et al. . | |
| 1,916,385 | 7/1933 | Oakes . | |
| 2,197,545 | 4/1940 | Bachman et al. . | |
| 2,253,758 | 8/1941 | Bulloch . | |
| 3,427,021 | 2/1969 | Donato . | |
| 4,139,193 | 2/1979 | Felber et al. . | |
| 4,309,029 | 1/1982 | Tomko . | |
| 4,653,746 | 3/1987 | Brunier | 482/83 |
| 4,662,630 | 5/1987 | Dignard et al. . | |
| 4,817,941 | 4/1989 | McCorry . | |
| 4,903,966 | 2/1990 | Liao . | |
| 4,913,419 | 4/1990 | McAuliffe . | |
| 5,046,724 | 9/1991 | Sotomyaer . | |
| 5,183,451 | 2/1993 | Hautamaki . | |
| 5,256,069 | 10/1993 | Snowden, Jr. et al. . | |
| 5,277,679 | 1/1994 | Wells . | |
| 5,389,057 | 2/1995 | Zagata, Jr. . | |
| 5,415,552 | 5/1995 | Harmon et al. . | |
| 5,472,395 | 12/1995 | Trocchio . | |
| 5,722,920 | 3/1998 | Bauer | 482/83 |

*Primary Examiner*—Jerome W. Donnelly
*Attorney, Agent, or Firm*—Pennie & Edmonds LLP

[57] ABSTRACT

The present invention relates generally to a martial arts practice device which includes a housing member adapted to be mounted onto a support and having at least one receiving portion, a striking member adapted to be mounted onto the housing member and a joint member positioned between the housing member and the striking member and having a first joining member captured in the receiving portion on the housing member and a second joining member mounted to the striking member. The second joining member of the joint member is deflectable relative to the first joining member of the joint member in all directions to provide the necessary tension both as for resistance of striking forces as well as for the return of the striking member to its original position after it is struck.

19 Claims, 15 Drawing Sheets

MARTIAL ARTS PRACTICE DEVICE

FIELD OF THE INVENTION

The present invention relates to a martial arts practice device and, particularly, a practice device that has a resilient joint member for mounting a striking member to a housing member. Moreover, the present invention relates to a martial arts device having a resilient joint member that mounts a striking member to a housing member and provides sufficient tension both for resisting striking forces and for returning the striking member to its original position after it is struck.

BACKGROUND OF THE INVENTION

Various training devices have been adopted for practicing martial arts. Typical practicing devices are disclosed in U.S. Pat. Nos. 5,389,057 to Zagata, Jr., 5,046,724 to Sotomayer, 4,913,419 to McAuliffe, 4,662,630 to Dignard et al., 1,733,709 to Zinnow et al. and 925,342 to Johnson. In particular, U.S. Pat. No. 5,046,724 to Sotomayer discloses a punching device for boxers that includes a pair of boxing bags attached to a post. Each boxing bag is connected to the upper post through an extension coil spring. The spring has one of its ends connected to the upper post through a bracket and the other end connected to a sphere. The spring and the sphere are situated internally to a rubber boot and padding layers respectively.

While these conventional device provide means for trainers to exercise various skills, they are ineffective in providing the required tension for training in the martial arts. Hence, conventional martial arts practice devices often fail to provide sufficient resistance to striking forces or to absorb various shock forces that occur during use of the practice device. Consequently, the striking member of such a conventional device will vibrate or rock tremendously after each blow, and this can cause inconvenience and potential hazards to the user.

Therefore, it is desirable to improve conventional martial arts practice devices so that they can provide the required tension both as to resistance of striking forces as well as for the return of the striking member to its original position after it is struck. The present invention provides a novel martial arts practice device that is capable of meeting these requirements.

SUMMARY OF THE INVENTION

The present invention relates generally to a martial arts practice device. The martial arts practice device comprises a housing member adapted to be mounted onto a support and having at least one receiving portion, a striking member adapted to be mounted onto the housing member and a joint member positioned between the housing member and the striking member and having a first joining member captured in the receiving portion on the housing member and a second joining member mounted to the striking member. Preferably, the second joining member is deflectable relative to the first joining member in all directions.

The joint member further comprises a resilient member having first and second end portions connected to the first and second joining members respectively. The resilient member may be a tension spring member. Preferably, the resilient member is a tension spring member which is enclosed by a resilient cover member. In this arrangement, the resilient cover member has first and second openings which correspond to the first and second end portions of the resilient member to receive the first and second joining members, respectively. In addition, the cover member may have an internal chamber preferably having a larger transverse dimension than that of the openings on the cover member to retain the spring member therein.

The striking member of the martial arts practice device of the present invention also may have a receiving chamber for partially capturing the second joining member and mounting the same therein. The striking member can further include a rigid tubular member and a padding member encasing the tubular member. The tubular member defines the receiving chamber of the striking member. Preferably, the receiving chamber of the striking member and the second joining member are both cylindrical and have substantially the same diameter so that the second joining member of the joint member can be snugly and securely fit inside the receiving chamber of the striking member.

The second joining member can be made of a resilient material. In a preferred embodiment, the second joining member and the resilient member form an integral and continuous tension spring member. In another preferred embodiment, the second joining member has a resilient plug member and a mounting head member at one end of the plug member. The plug member has a diameter substantially the same as that of the receiving chamber of the striking member. The mounting head member has a mounting portion fixed with the plug member and a thread member extending beyond the end of the plug member. In this preferred embodiment, the resilient member is constructed to have a thread opening at one end portion thereof for receiving the thread member on the second joining member.

In a preferred embodiment of the present invention, the first joining member has a cartridge member captured in the receiving portion of the housing member and connected to the resilient member. The first joining member can further include a collar member that is fixed to the cartridge member and extending beyond the housing member toward the striking member. The collar member has a through chamber portion that retains at least a portion of the resilient member therein. In an alternative embodiment, the first joining member is a pin member and the housing member has at least one receiving aperture to capture the pin member.

The housing member of the martial arts practice device can have a contoured rear panel member conforming to the surface of the support and fastening member for mounting the housing member to the support.

The martial arts practice device of the present invention can further comprise at least one interchangeable joint member. The joint member and the interchangeable joint member are both resilient and preferably differ in tension.

In another embodiment, the present invention relates to a martial arts practice device comprises a housing member adapted to be mounted onto a support and having at least one receiving portion, a striking member adapted to be mounted onto the housing member and a joint member for mounting the striking member to the housing member. This joint member comprises a resilient member having first and second end portions. A first joining member is provided to connect to the first end portion of the resilient member and adapted to be mounted to the housing member. A second joining member is provided to connect to the second end portion of the resilient member and adapted to be mounted to the striking member. The second joining member is deflectable relative to the first joining member in all directions.

In a preferred embodiment, the resilient member in the joint member comprises a tension spring member and a resilient cover member that encases the spring member. The resilient cover member can further have first and second opening portions at the first and second end portions of the resilient member to receive the first and second joining members respectively. The cover member is preferably made of 65 durometer natural black rubber.

BRIEF DESCRIPTION OF THE DRAWINGS

These and other features, aspects, and advantages of the present invention will become much more apparent from the following description, appended claims, and accompanying drawings, in which:

DETAILED DESCRIPTION OF THE PREFERRED EMBODIMENT

Figure 1:
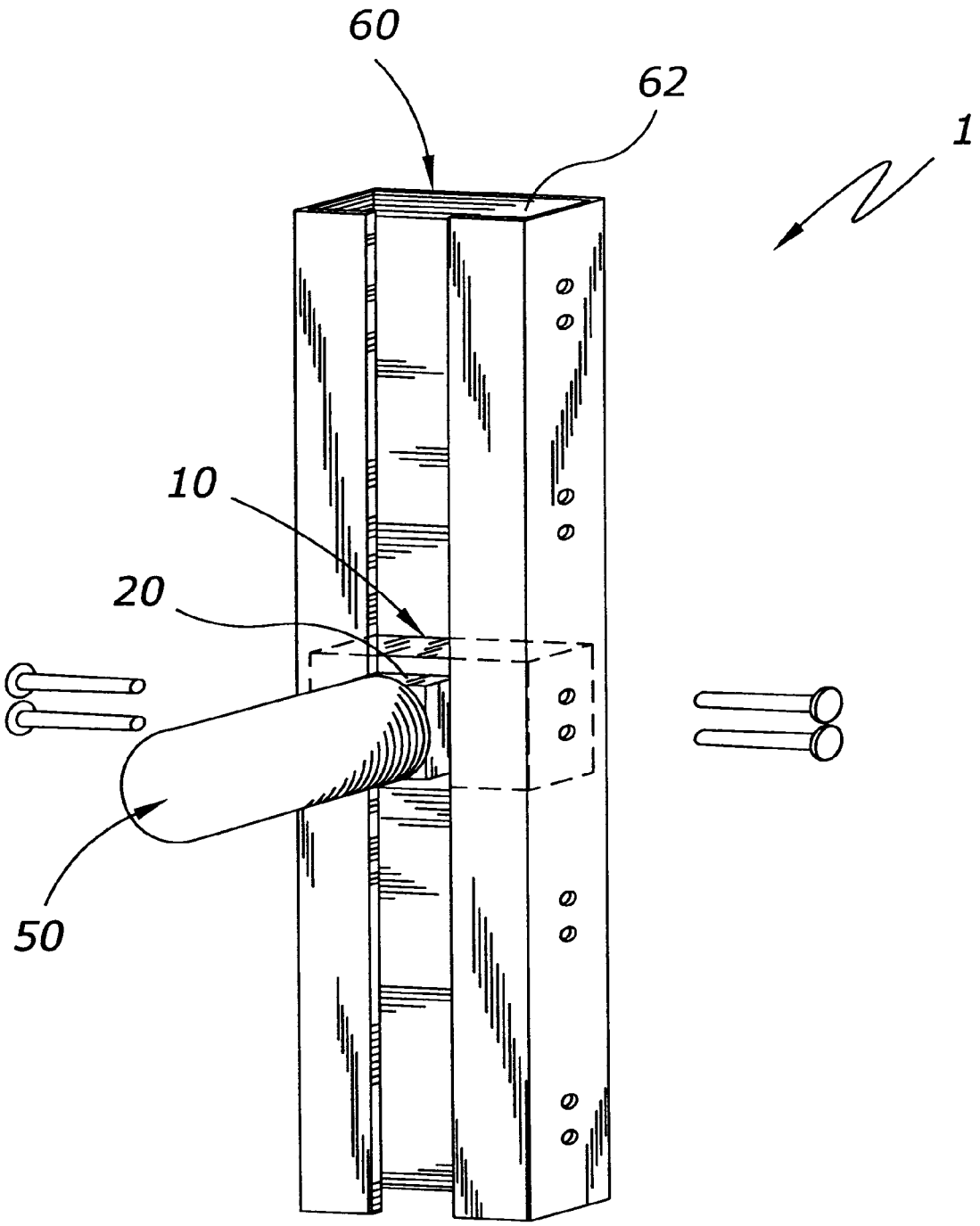
FIG. 1 is a perspective view of a martial arts practice device according to the present invention.
Figure 2:
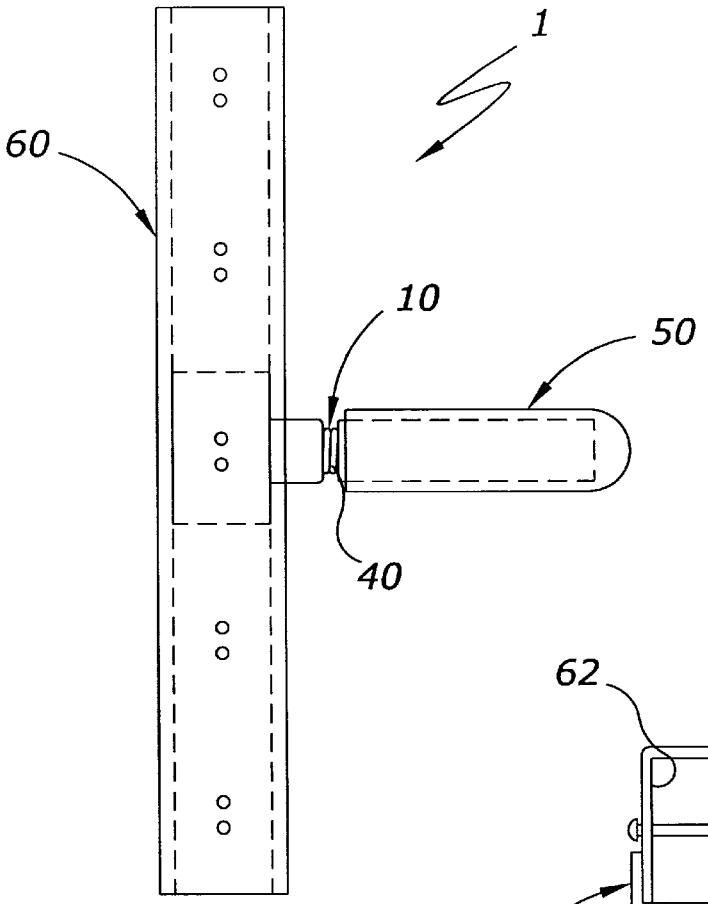
FIG. 2 is a side view of the practice device as shown in FIG. 1.
Figure 3:
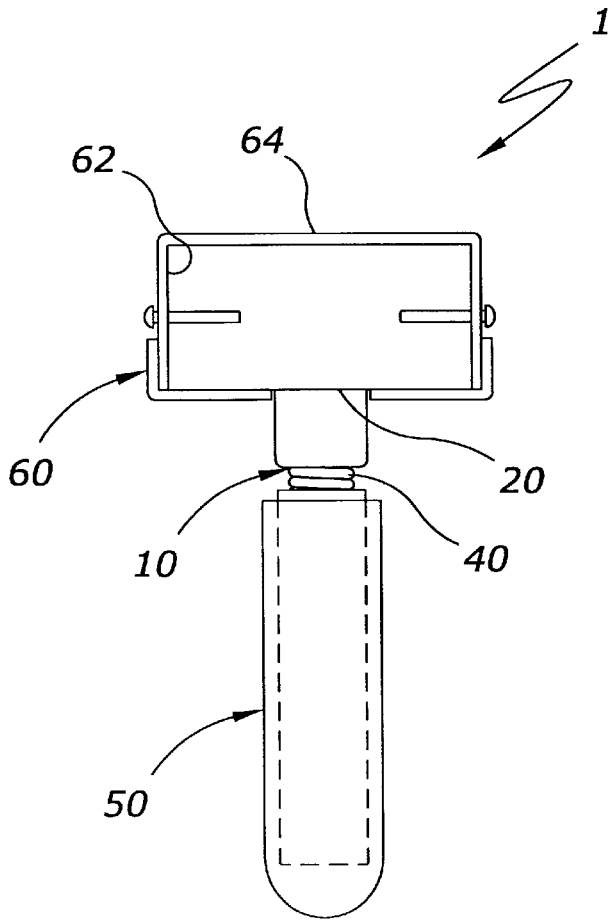
FIG. 3 is a top view of the practice device as shown in FIG. 1.

Various martial arts practice devices embodying the principles of the present invention are illustrated in FIGS. 1 to 20. The practice device of the present invention are capable of providing sufficient tension both for the return of the striking member to its original position after being struck and to the resist the striking force. In each embodiment, the same elements are designated with the same reference numerals and repetitive descriptions are omitted.

The martial arts practice device of the present invention is generally designated by reference numeral 1. As depicted in the drawings and particularly in FIGS. 1 to 3 and 13 to 15, the martial arts practice device 1 of the present invention features in a joint member 10. The joint member 10 is positioned between a striking member 50 and a housing member 60 and mounts the striking member 50 to the housing member 60.

More specifically, the joint member 10 has a first joining member 20 captured in a receiving portion 62 on the housing member 60 and a second joining member 30 mounted to the striking member 50. In addition, the joint member 10 has a resilient member 40 that includes two end portions 42, 44 connected to the first and second joining members 20 and 30 respectively. The resilient member 40 thus allows the second joining member 30 to deflect relative to the first joining member 20 in all directions. Thereby, the striking member 50 of the practice device 1 is capable of receiving striking forces from virtually all directions and providing shock absorption for all such striking forces.

In a preferred embodiment shown in FIGS. 1 to 13, the joint member 10 of the martial arts practice device 1 employs a tension spring member 40 as its resilient member. The tension spring member 40 can be a coil spring with a generally cylindrical shape as shown in FIGS. 2 to 5. The spring member 40 has such a tension that enables the striking member 50 to return to its original position with minimum vibration and allows the trainer to follow through the target after striking action without causing stress to the trainer's body parts.

Figure 4:
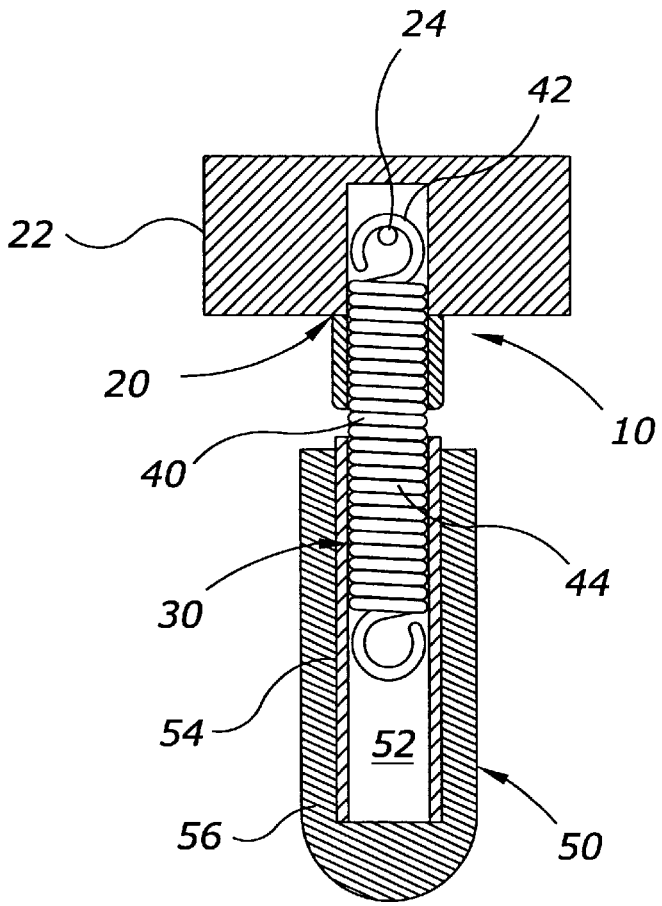
FIG. 4 is a cross-sectional view of the combination of the joint member and the striking member of the practice device as shown in FIG. 1.
Figure 5:
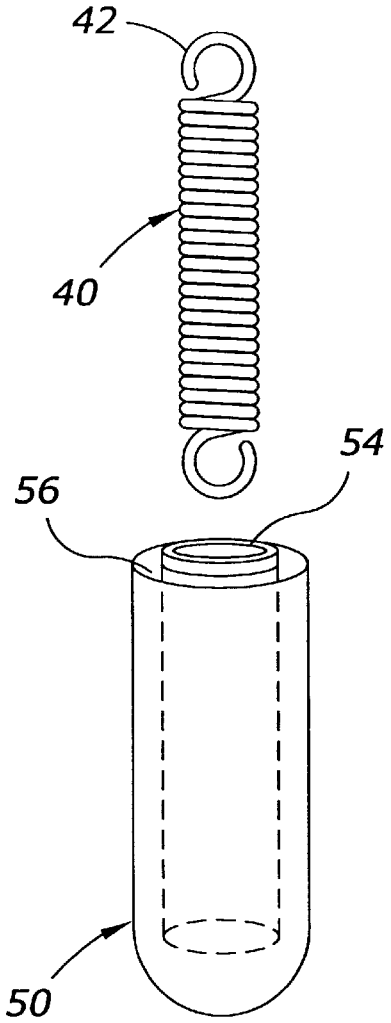
FIG. 5 is an exploded view of the combination of the resilient and striking member as shown in FIG. 1.

One end 42 of the spring member 42 is adapted to connect to the first joining member 20 by various conventional means. Preferably, the spring member 40 is movably connected to the first joining member 20 so that the practice device 1 can be easily disassembled when not in use. As shown in FIGS. 4 and 5, the spring member 40 has a hooked end 42 that engages the first joining member 20 through a screw member 24. In this particular embodiment, the resilient member 40 and the second joining member 30 are an integral and continuous tension spring member 40.

Figure 6:
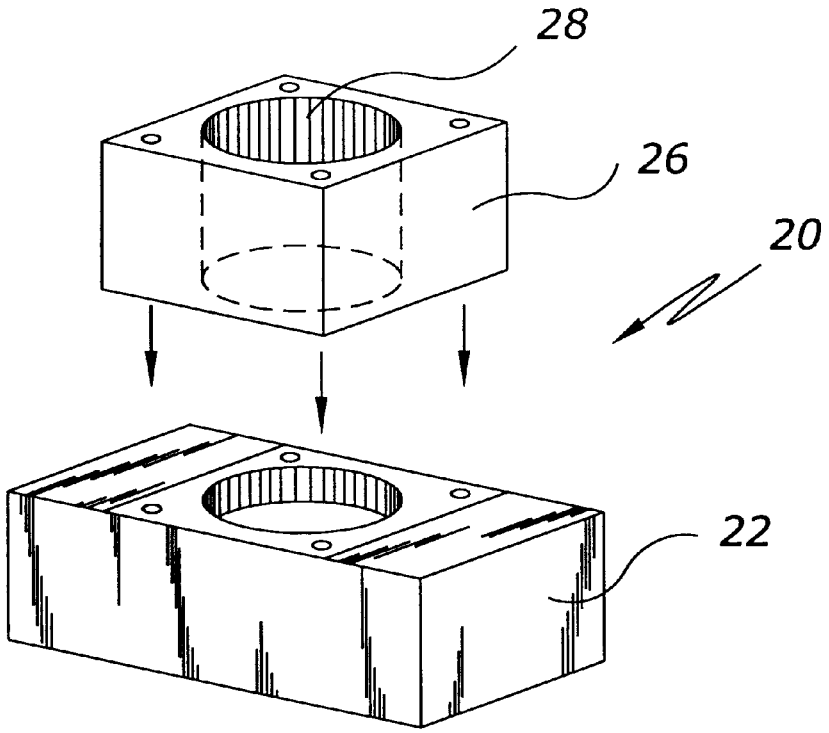
FIG. 6 is an exploded view of the first joining member of the practice device as shown in FIG. 1.
Figure 7:
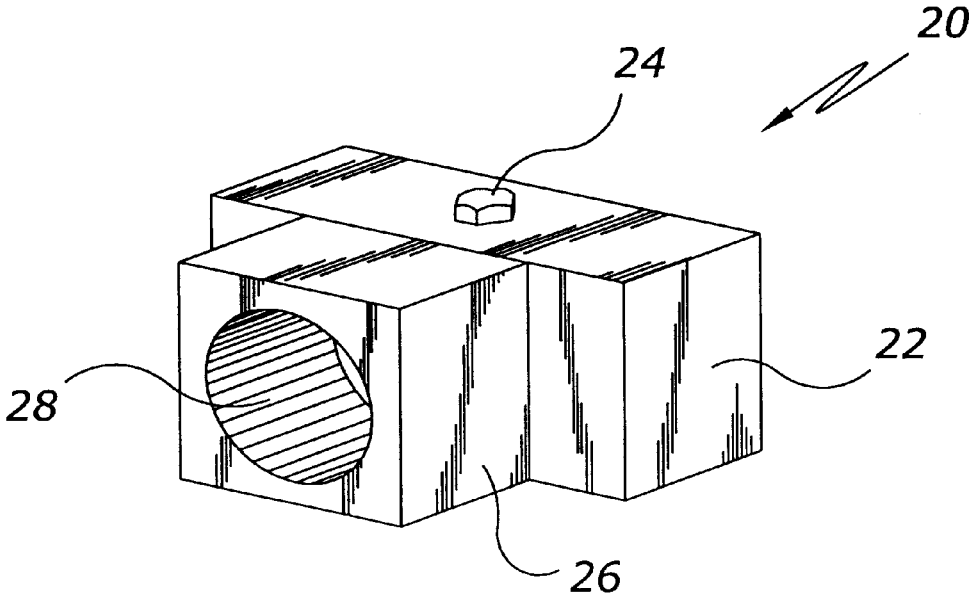
FIG. 7 is a perspective view of the first joining member as shown in FIG. 1.

As shown in FIGS. 4, 6 and 7, the first joining member 20 in this preferred embodiment comprises a cartridge member 22. The cartridge member 22 is captured in the receiving portion 62 on the housing member 60 as will be further described hereinafter. At the same time, the cartridge member 22 connects to the resilient member 40, i.e., the spring member 40 through the screw member 24. It is understood that other conventional connection means can also be used to connect the cartridge member 22 with the resilient member 40.

The first joining member 20 further comprises a collar member 26 that is fixed to the cartridge member 22. After the practice device 1 is assembled, the collar member 26 extends beyond the housing member 60 toward the striking member 50. The collar member 26 has a through chamber portion 28 therein that acts to retain at least a portion of the resilient member 40. The collar member 26 is thus particularly advantageous for the martial art practice device 1 since it can effectively reduce various shocks generated in the joint member 10 upon striking.

The first joining member 20 can be made of various conventional materials and through various conventional method. In a preferred embodiment, the first joining member 20 is made of wood. In another preferred embodiment, the first joining member 20 is made of a plastic material through a molding process such as injection molding. The cartridge member 22 and the collar member 26 can be integrally molded to form a unitary piece. Further, the cartridge member 22 can also be molded with the spring member 40 encased therein.

Figure 8:
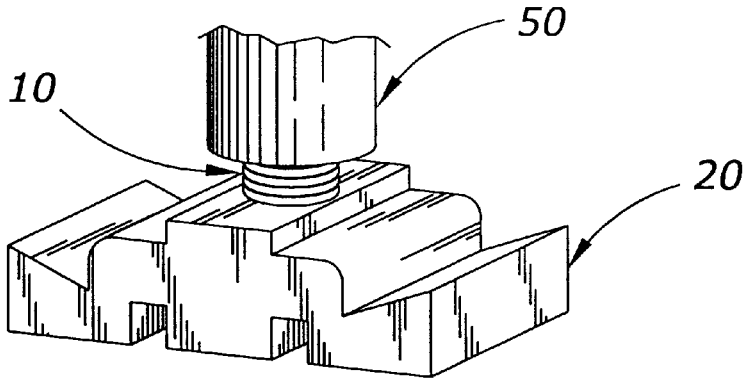
FIG. 8 shows a variation of the first joining member according to the present invention.
Figure 9:
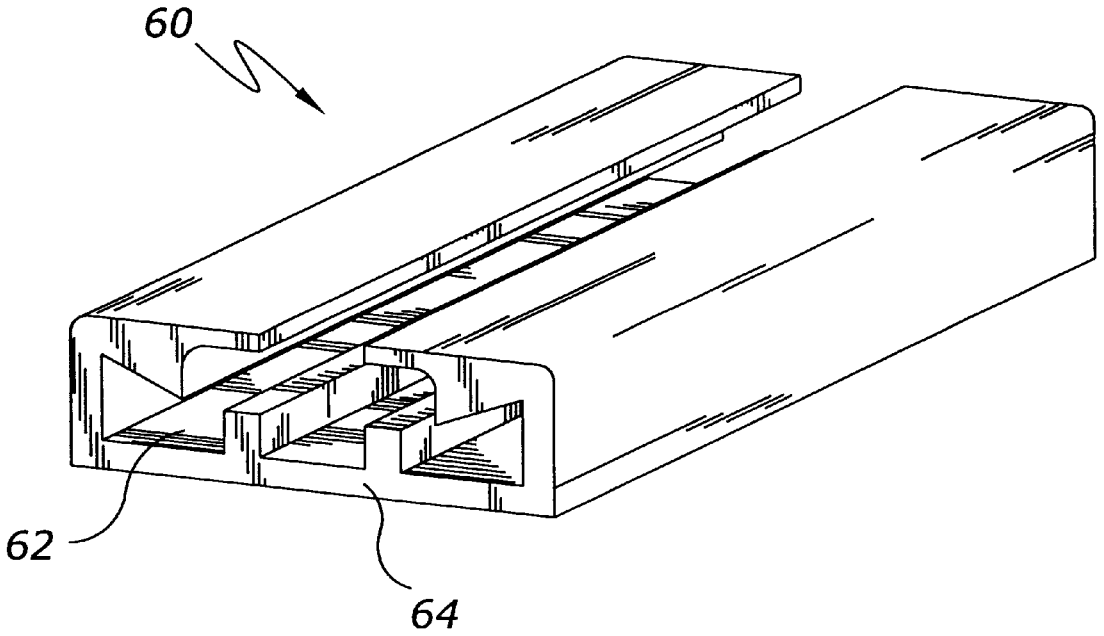
FIG. 9 shows a variation of the housing member complementary to the first joining member shown in FIG. 8.

Other shaped first joining member 20 can also be employed in the practice device 1 of the present invention. FIG. 8 shows a variation of the first joining member 20 as previously described. To receive so formed first joining member 20, the receiving portion 62 in the housing member 60 is constructed in a complementary shape as shown in FIG. 9.

The striking member 50 of the martial arts practice device 1 comprises a receiving chamber 52. The receiving chamber 52 is adapted so that the second joining member 30 can extend at least partially thereinto and be mounted therein. More specifically, the striking member 50 can comprise a rigid tubular member 54 and a padding member 56 encasing the tubular member 54. The tubular member 54 can be formed of various materials such as metal and plastics. It is understood that the tubular member 54 acts to define the receiving chamber 52 in the striking member 50.

Preferably, both the second joining member 30 of the joint member 10 and the receiving chamber 52 in the striking member 50 are shaped cylindrical. More preferably, they have substantially the same diameter so that the second joining member 30 of the joint member 10 can be securely fit inside the receiving chamber 52 of the striking member 50. The insertion of the second joining member 30 into the receiving chamber 52 provides a secured connection between the joint member 10 and the striking member 50. In addition, when the second joining member 30 is made of a resilient material, the martial arts practice device 1 thus formed is more advantageous in absorbing shocks generated by striking.

FIGS. 1 to 3, 11 and 12 show various housing members 60 employed in the practice device 1, which generally have an elongated shape. Each housing member 60 has at least one receiving portion 62 thereon for capturing the second joining member 20 of the joint member 10. More specifically, the receiving portion 62 is in the form of a pair of longitudinally oriented channels opening toward each other. Thereby, the first joining member 20 is capable to slide along the channels 62 to a desired position. Additional pins 61 are used to fit into holes in the housing member 60 and the first joining member to thereby fix the first joining member 20 in the desired position.

Figure 10A:
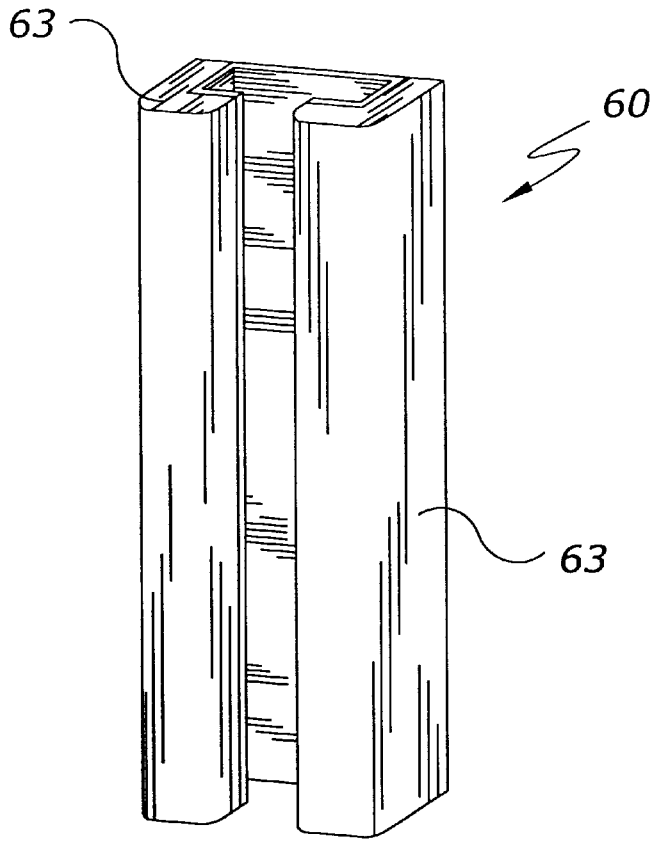
FIGS. 10*a* and 10*b* are perspective views of the housing member having padding members affixed thereto.
Figure 10B:
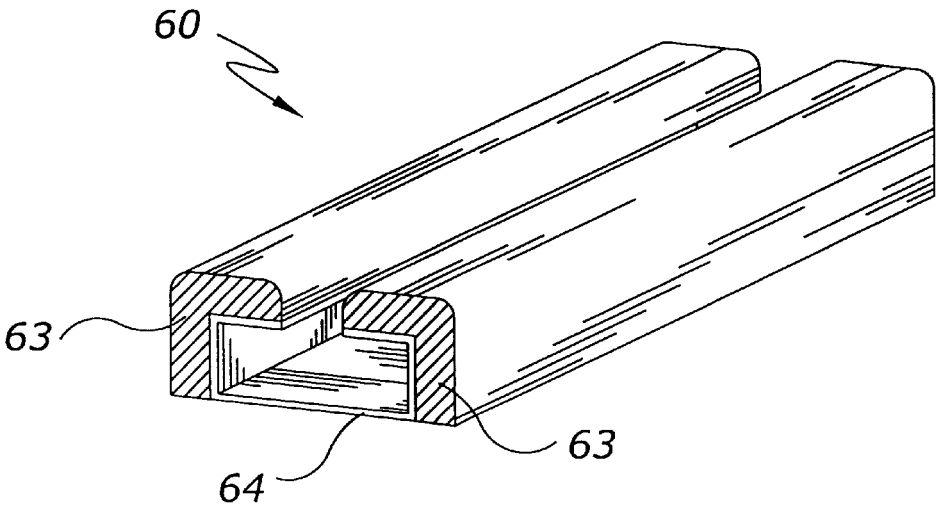
Figure 11A:
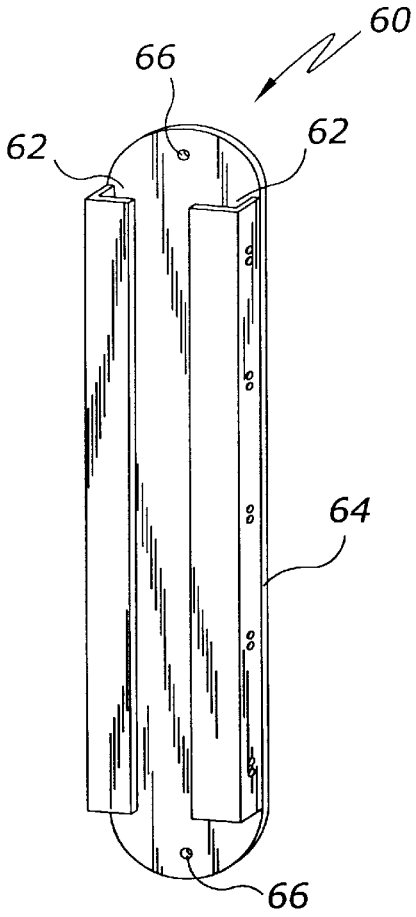
FIGS. 11*a* to 11*c* are perspective and partial perspective views of the housing member of the martial arts practice device of the present invention.
Figure 11B:
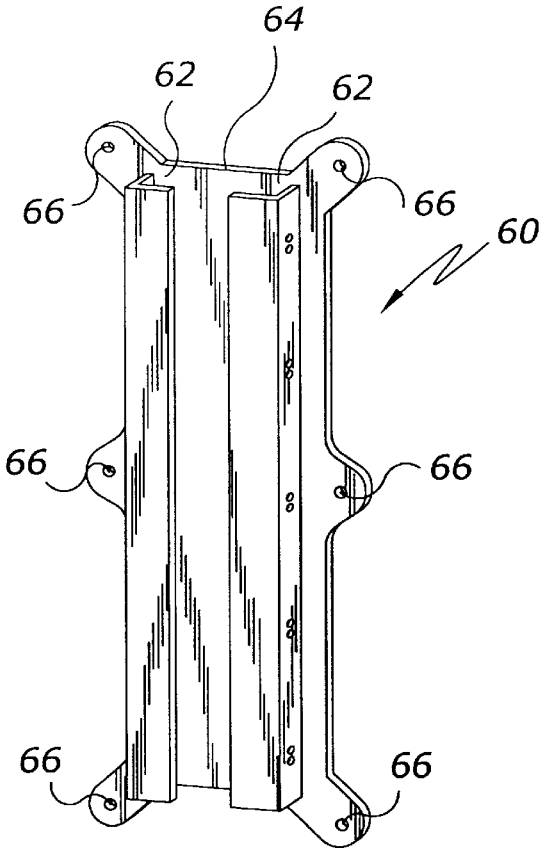
Figure 11C:
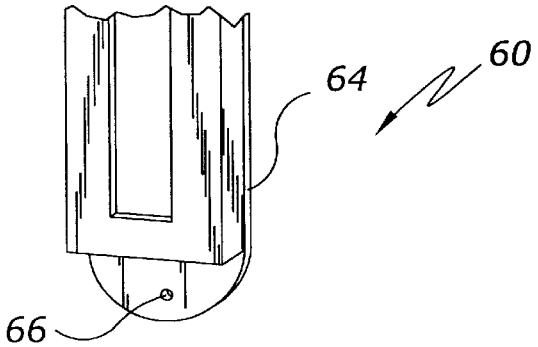
Figure 12A:
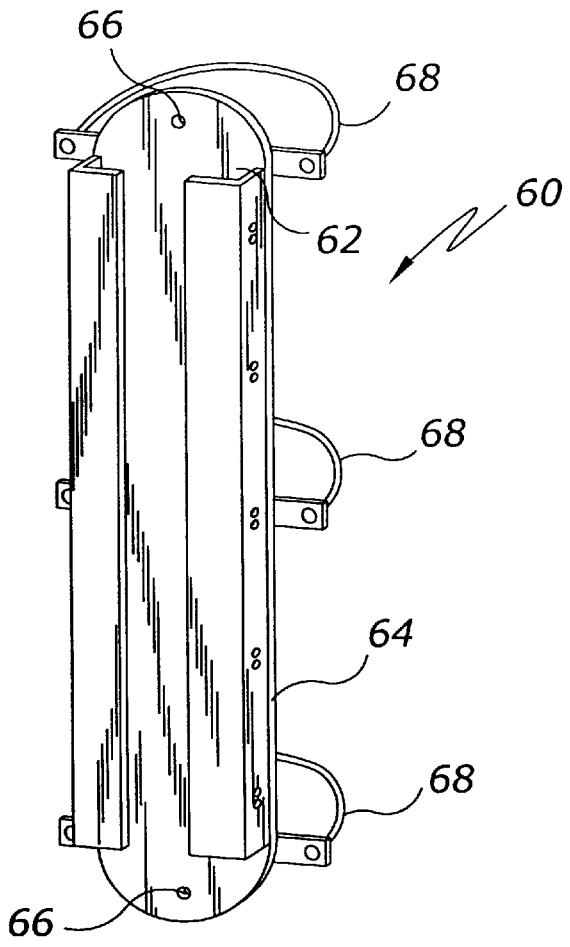
FIGS. 12*a* and 12*b* are perspective and top views of a further variation of the housing member.
Figure 12B:
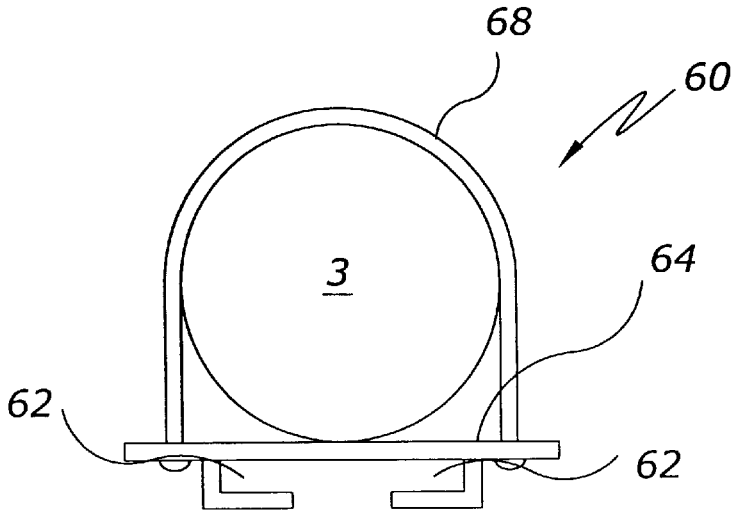

The housing member 60 of the martial arts practice device 1 can be constructed in various ways. In a preferred embodiment as shown in FIGS. 10*a* and 10*b*, the housing member 60 employs a padding member 63 to protect trainers from any injury. The housing member 60 can have a contoured rear panel member 64 that conforms to the surface of the support. Thereby, the entire practice device 1 can be more securely mounted to a separate support. In the embodiments shown in various drawings, the rear panel member 64 has a generally flat shape so as to securely mounting the practice device 1 onto a wall support. The rear panel member 64 can also have various plane shapes as shown in FIGS. 11 and 12.

Various materials can be used to constitute the housing member 60. In a preferred embodiment, the housing member 60 is formed by assembling elongated rear, side and front panel members. Alternatively, the housing member 60 can be molded with plastic materials.

Figure 13:
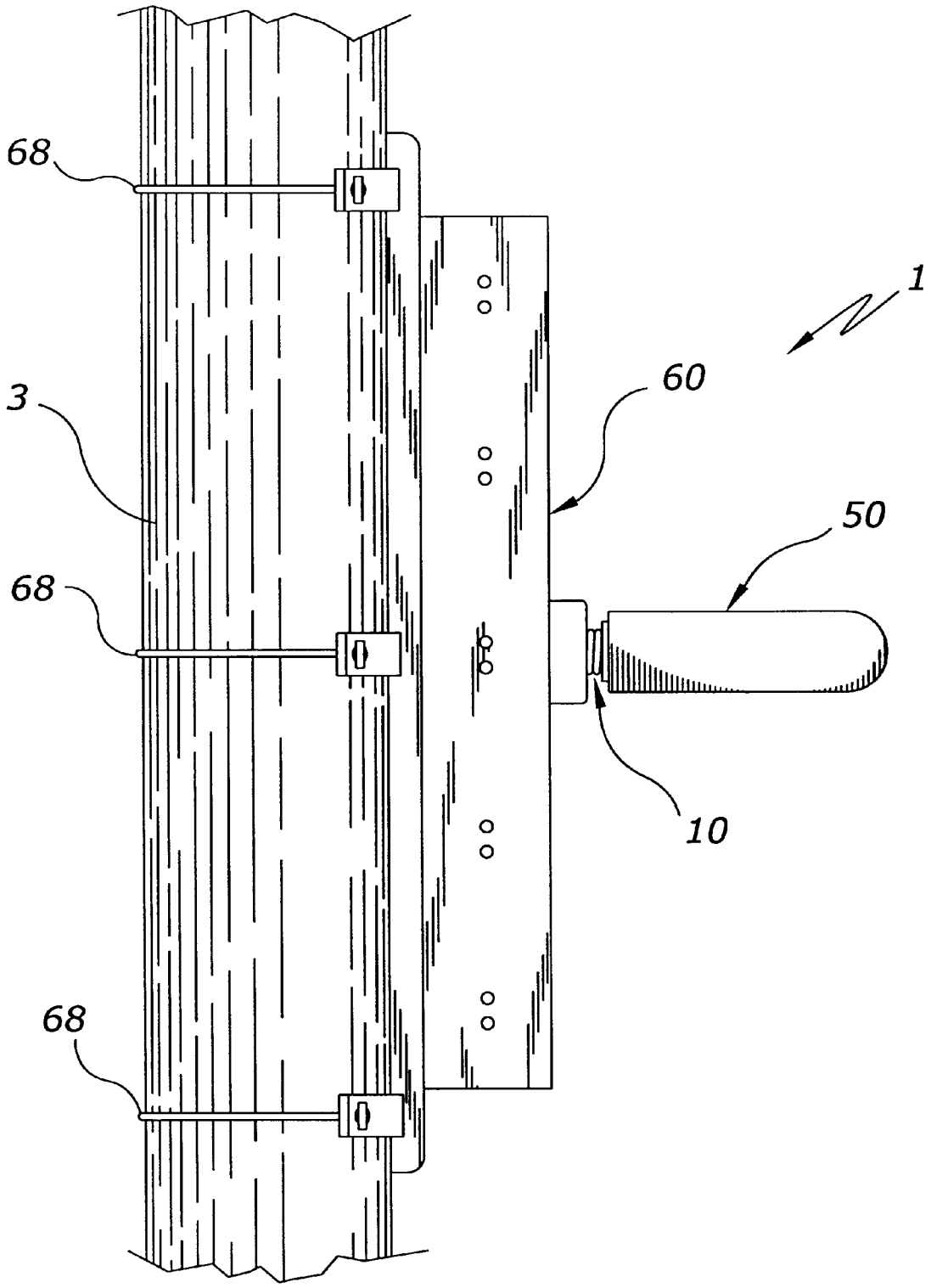
FIG. 13 is a side view showing the martial arts practice device, with the varied housing member as shown in FIGS. 12*a* and 12*b*, being mounted to a post member.
Figure 14:
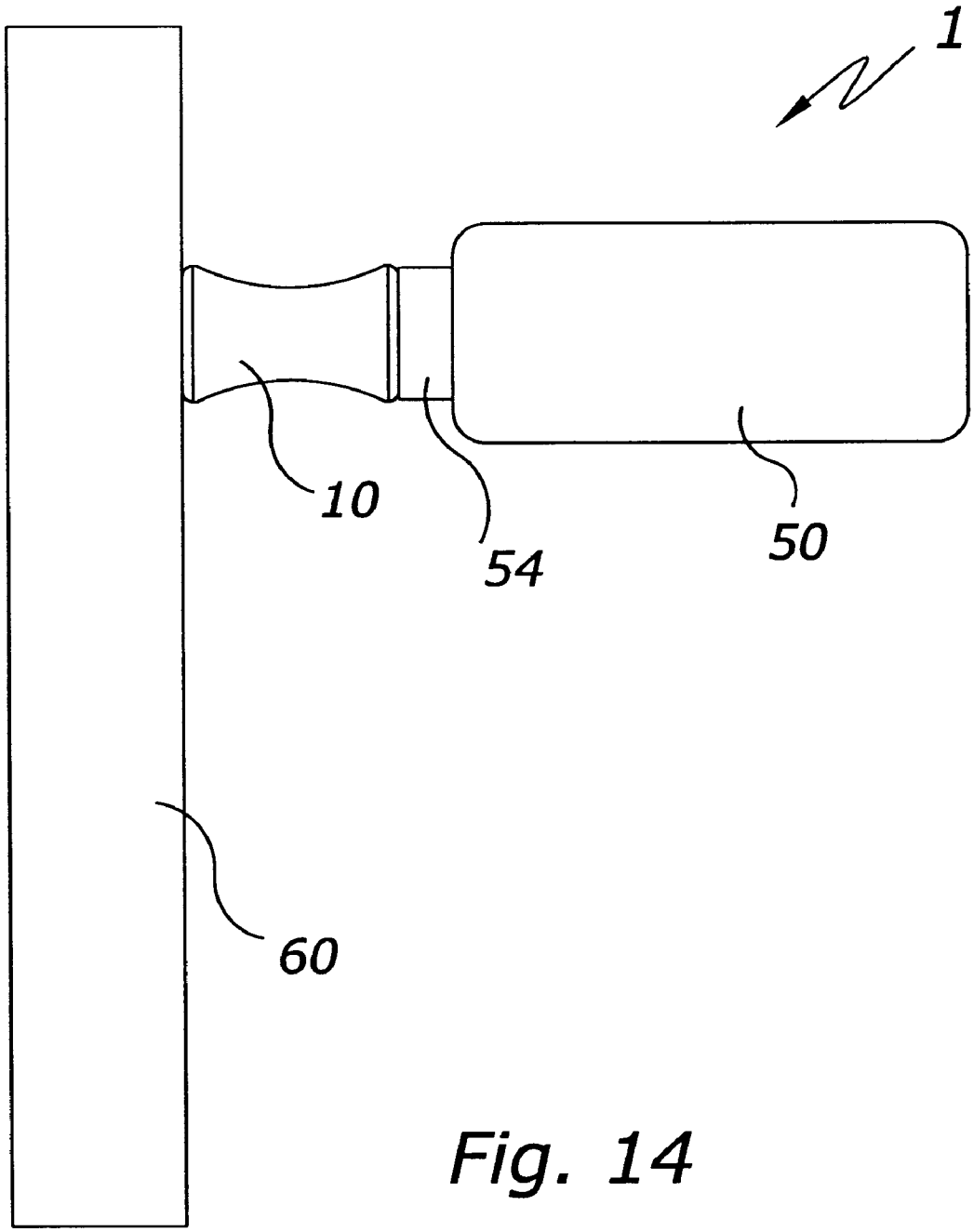
FIG. 14 is a side view of an alternative martial arts practice device according to the present invention.

Moreover, the housing member 60 of the practice device 1 can have a plurality of fastening members 66 thereon to facilitate mounting the housing member 60 onto a support. The fastening members 66 can be through holes provided on the rear panel member 64, as shown in various drawings, for mounting the practice device 1 onto a flat surface of a support, such as a wall surface. Additional flexible securing members 68, such as cable and belt members, can be provided to assist in mounting the practice device 1 to a post support 3 as shown in FIGS. 12 and 13.

FIGS. 14 to 20 illustrate an alternative preferred embodiment of the martial arts practice device. In the alternative preferred embodiment, the resilient member 40 is in the form of a combination of a cover member 45 and a tension spring member 40' embedded in the cover member 45 as shown in FIG. 16*b*. Various materials and method can be used to form the resilient cover member 45. In a preferred embodiment, the resilient member 45 is molded from a hard elastomeric material, such as 65 durometer natural black rubber, around the spring member 40'.

The resilient cover member 45 preferably has a cylindrical shape terminated between end portions 42 and 44. The end portions 42 and 44 are preferably tapered so that the resilient cover member 45 can more effectively engage both the striking member 50 and the housing member 60 to provide sufficient shock absorption.

At each end portion 42 or 44 of the resilient cover member 45, there is an opening portion 47*a* or 47*b* provided for receiving the first and second joining members 20 and 30 respectively. The connection therebetween can be accomplished through various conventional means such as tight fit and screw connection. In the preferred embodiment shown in FIG. 16*b*, the second opening portion 47*b* on the resilient cover member 45 has a female thread member provided thereon to thus removably engage with a male thread member on the second joining member 30 as discussed hereinafter.

The resilient cover member 45 also includes an internal chamber 49 that preferably has a cylindrical shape. As shown in FIG. 16*b*, the internal chamber 49 of the resilient member 40 communicates with the opening portions 47*a* and 47*b*. The internal chamber 49 preferably has a larger transverse dimension than that of the opening portions on the resilient cover member 45 so as to retain the spring member 40' therein.

Figure 17:
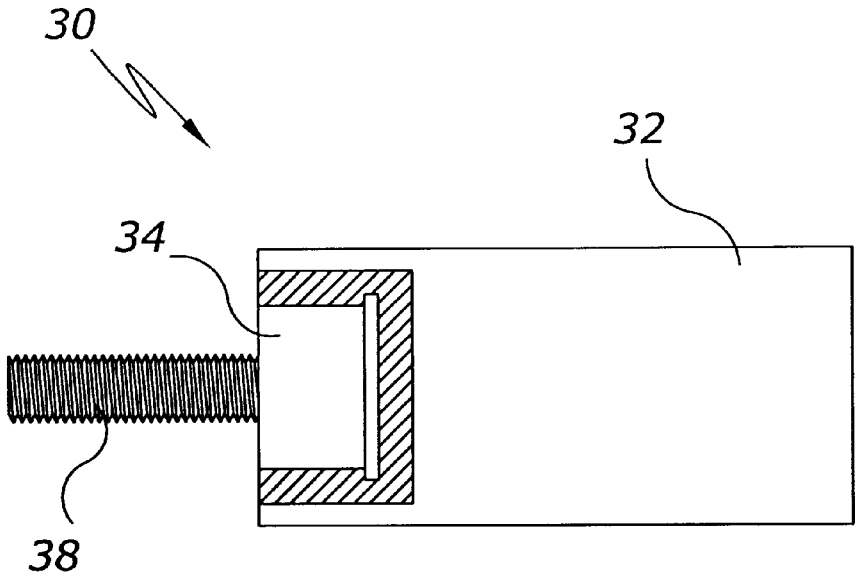
FIG. 17 is a side view of a second joining member of the joint member in the alternative practice device as shown in FIG. 14.
Figure 18:
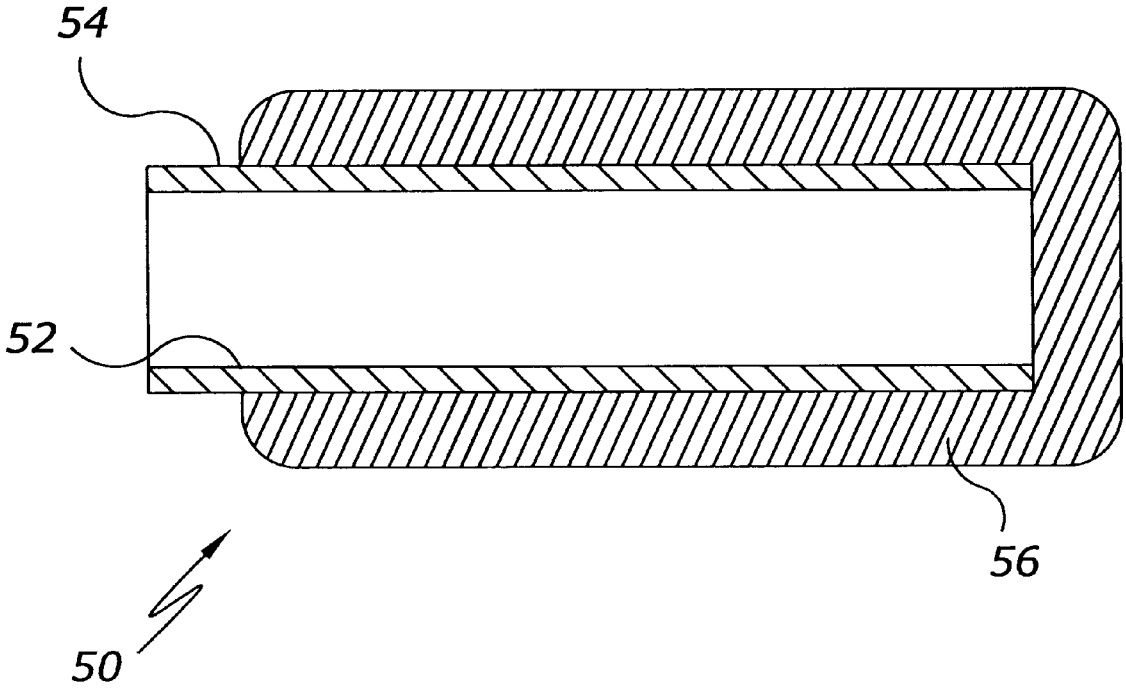
FIG. 18 is a cross-sectional view of the striking member in the alternative device as shown in FIG. 14.

The second joining member 30 of the present invention comprises a resilient plug member 32 as shown in FIG. 17. The plug member 32 has a diameter that is substantially the same as that of the receiving chamber 52 of the striking member 50 as shown in FIG. 18. In this manner, the plug member 32 can be tightly fit inside the receiving chamber 52. Moreover, the second joining member 30 comprises a mounting head member 34 at one end of the plug member 30. The mounting head member 34 has a mounting portion 36 fixed with the plug member 32 and a male thread member 38 extending beyond the same end of the plug member 32. The male thread member 38 is adapted to removably engage with the female thread member 47*b* on the resilient member 40. Thereby, the joint member 10 is capable of connecting the striking member 50 onto the housing member 60.

Figure 15:
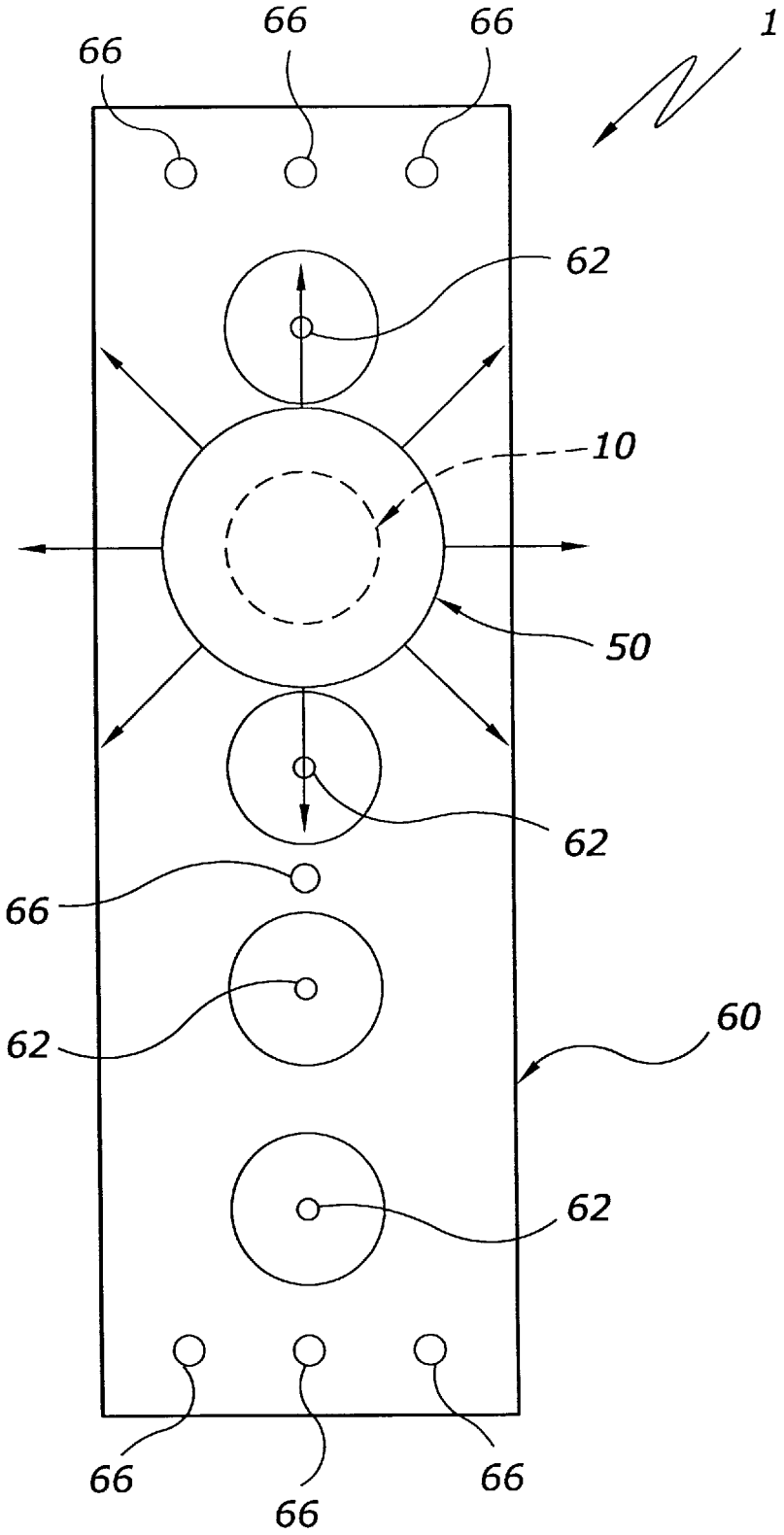
FIG. 15 is a front view of the practice device as shown in FIG. 14.
Figure 16A:
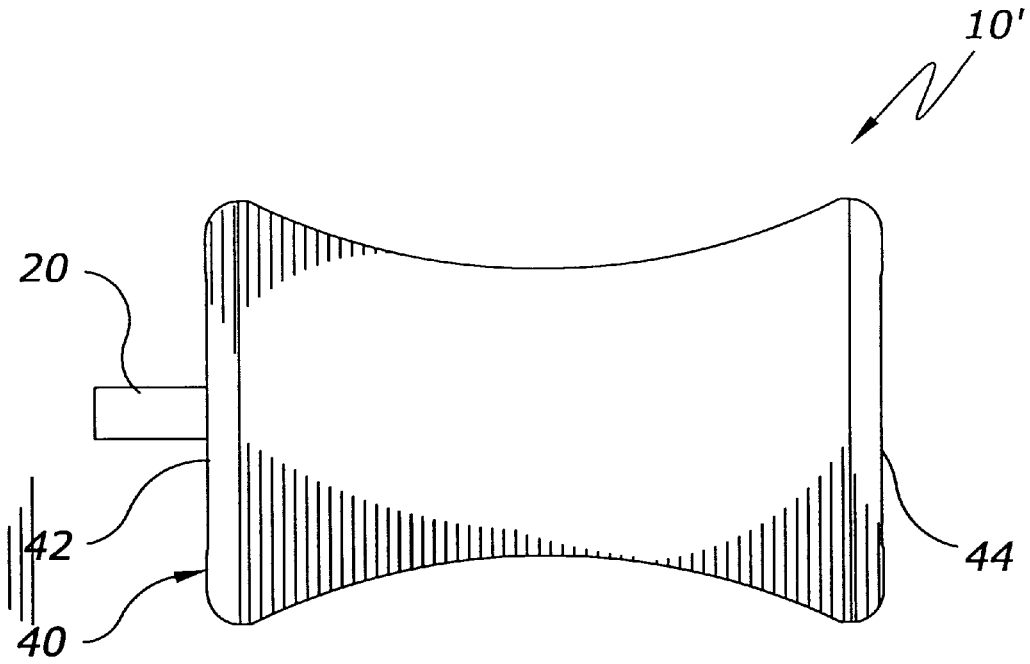
FIGS. 16*a* and 16*b* are side and cross-sectional views of the joint member in the alternative practice device as shown in FIG. 14.
Figure 16B:
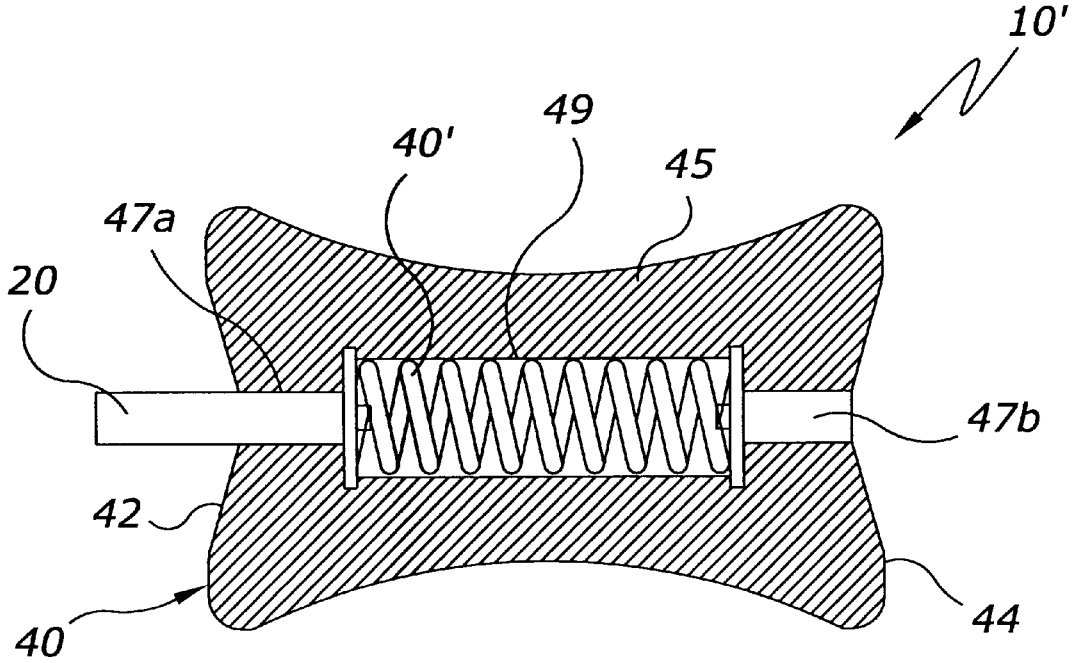
Figure 19:
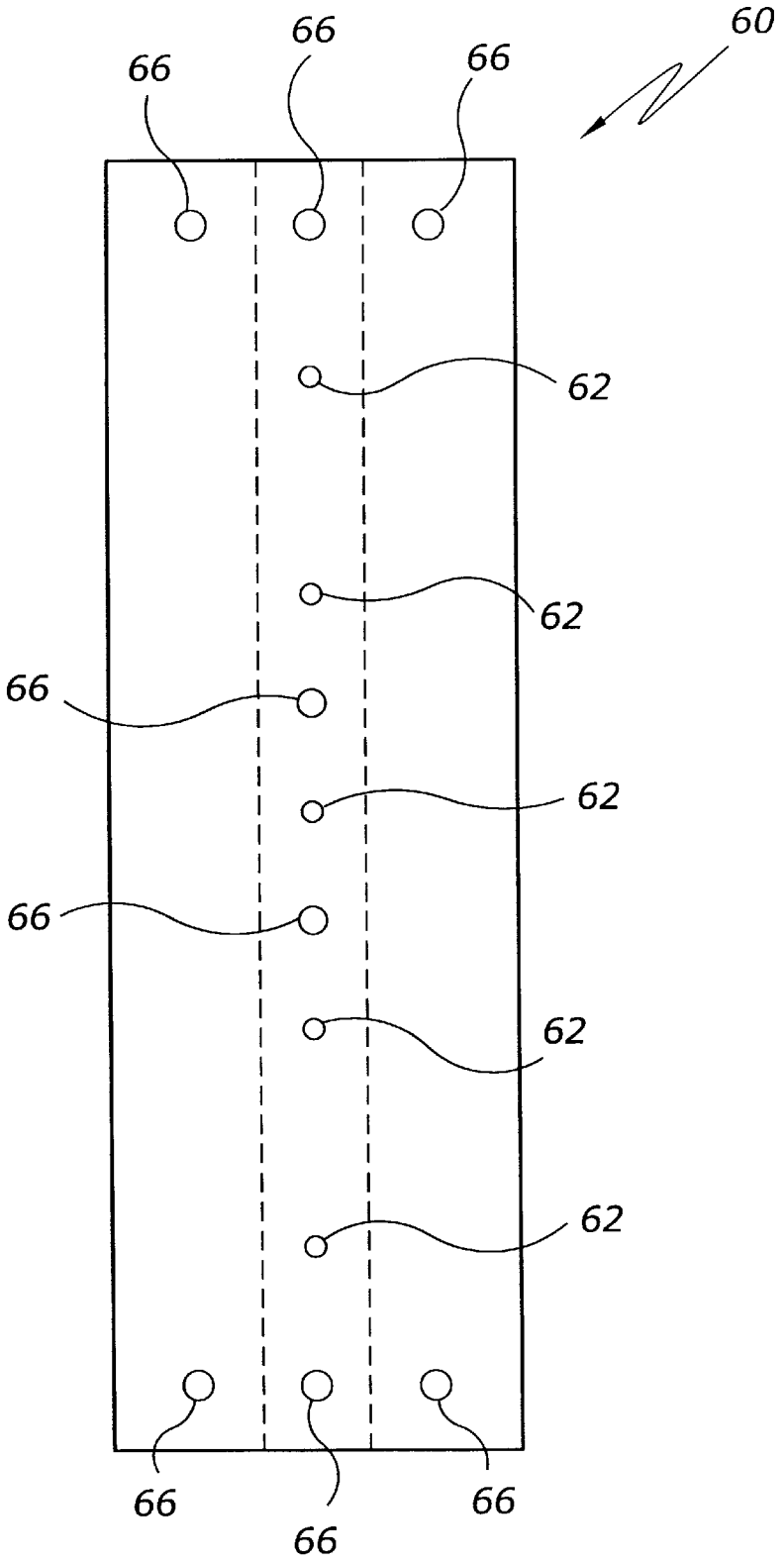
FIG. 19 is a rear view of the housing member in the alternative practice device as shown in FIG. 14.
Figure 20:
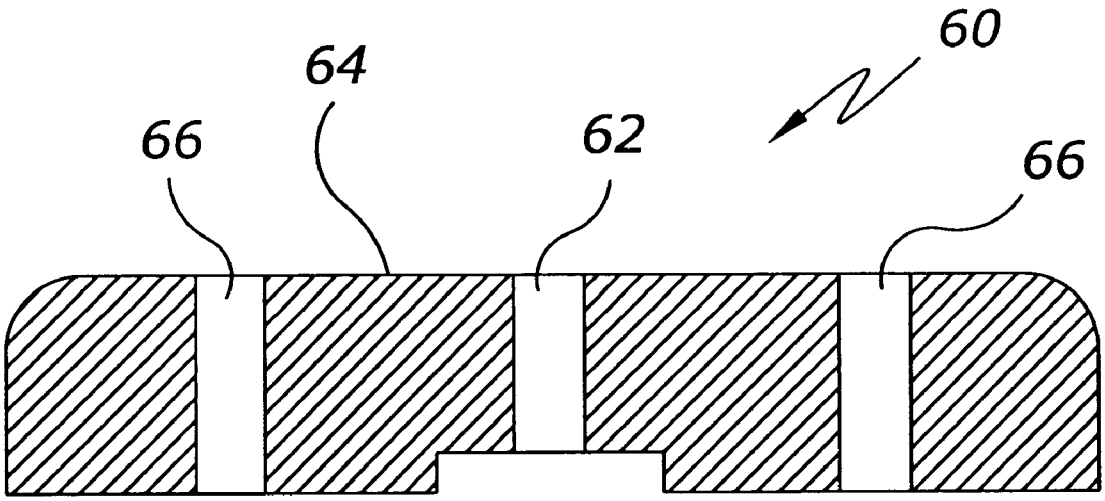
FIG. 20 is a transverse cross-sectional view of the housing member as shown in FIG. 19.

In this preferred embodiment, the first joining member 20 can be simplified as a pin member as shown in FIGS. 16*a* and 16*b*. The receiving portion 62 on the housing member 60 is thus formed as at least one receiving hole for capturing the pin member 20 as shown in FIGS. 15, 19 and 20. The pin member 20 and receiving hole 62 connection facilitates a quick and convenient assembly of the striking member 50 and the housing member 60 and thus is advantageous when a plurality of interchangeable joint members 10 are employed in the practice device 1.

The martial arts practice device 1 of the present invention can further comprise a plurality of interchanging joint members 10. Each of such joint members 10 can have a similar construction to that described hereinabove except that it has a different tension from other joint members 10. These joint members 10 are all interchangeable with each other. In the embodiment shown in FIGS. 16*a* and 16*b,* the resilient member 40 and the first joining member 20 are formed as a unit and can be replaced by an interchangeable unit 10'. In this manner, the martial arts practice device 1 of the present invention can provide different resistance for different levels of expertise to practice.

As a result of the structural features of the present invention, the martial arts practice device 1 can be used to practice virtually all types of kicks such as inside out and outside in crescent kicks, spinning and jumping spinning crescents, hook kicks, spinning hook kicks and even axe kicks. Moreover, the martial arts practice device 1 of the present invention can be used to practice traditional karate reverse punches and back fists, boxer's jabs, hooks and uppercuts and every angle of Muay Thai elbow flow drills. Further, the construction of the present invention and particularly the resilient joint member 10 in the martial arts practice device 1 provide the required resistance to thereby ensure a quick return of the striking member 50 after each strike and allow the trainer to follow through the target without causing any stress to the body parts.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A martial arts practice device comprising:

a housing member adapted to be mounted onto a support and having at least one receiving portion;

a striking member adapted to be mounted onto the housing member; and a joint member positioned between the housing member and the striking member and having a resilient member having first and second end portions, a first joining member connected to the first end portion of the resilient member and adapted to be captured in the receiving portion on the housing member and a second joining member connected to the second end portion of the resilient member and adapted to be mounted on the striking member, wherein the second joining member of the joint member is resilient.

2. The martial arts practice device of claim 1 wherein the resilient member comprises a tension spring member.

3. The martial arts practice device of claim 1 wherein the resilient member comprises a tension spring member and a resilient cover member encasing the spring member, the resilient cover member having first and second openings corresponding to the first and second end portions of the resilient member to receive the first and second joining members respectively.

4. The martial arts practice device of claim 3 wherein the cover member comprises an internal chamber having a larger transverse dimension than that of the openings on the cover member to retain the spring member therein.

5. The martial arts practice device of claim 1 wherein the striking member comprises a receiving chamber, the second joining member extending at least partially into and mounted inside the receiving chamber.

6. The martial arts practice device of claim 5 wherein the striking member comprises a rigid tubular member and a padding member encasing the tubular member, the tubular member defining the receiving chamber of the striking member.

7. The martial arts practice device of claim 5 wherein the second joining member and the receiving chamber in the striking member are both cylindrical and have substantially the same diameter so that the second joining member on the joint member can be securely fit inside the receiving chamber of the striking member.

8. A martial arts practice device comprising:

a housing member adapted to be mounted onto a support and having at least one receiving portion;

a striking member adapted to be mounted onto the housing member; and a joint member positioned between the housing member and the striking member and having a first joining member captured in a receiving portion on the housing member and a second joining member mounted on the striking member, wherein the second joining member of the joint member is deflectable relative to the first joining member in all directions, the joint member further comprises a resilient member having first and second end portions connected to the first and second joining members respectively, the striking member comprises a receiving chamber, the second joining member extends at least partially into and is mounted inside the receiving chamber, and the second joining member is made of a resilient material.

9. The martial arts practice device of claim 7 wherein the second joining member and the resilient member form an integral and continuous tension spring member.

10. A martial arts practice device comprising:

a housing member adapted to be mounted onto a support and having at least one receiving portion;

a striking member adapted to be mounted onto the housing member; and a joint member positioned between the housing member and the striking member and having a first joining member captured in a receiving portion on the housing member and a second joining member mounted on the striking member, wherein the second joining member of the joint member is deflectable relative to the first joining member in all directions, the joint member further comprises a resilient member having first and second end portions connected to the first and second joining members respectively, the striking member comprises a receiving chamber, the second joining member extends at least partially into and is mounted inside the receiving chamber, the second joining member and the receiving chamber in the striking member are both cylindrical and have substantially the same diameter so that the second joining member on the joint member can be securely fitted inside the receiving chamber of the striking member, and the second joining member comprises a resilient plug member, the plug member having a diameter substantially the same as that of the receiving chamber of the striking member.

11. The martial arts practice device of claim 10 wherein the second joining member further comprises a mounting head member at one end of the plug member, the mounting head member having a mounting portion fixed with the plug member and a thread member extending beyond the end of the plug member, the resilient member comprising a thread opening at one end portion thereof receiving the thread member on the second joining member.

12. The martial arts practice device of claim 1 wherein housing member comprises a contoured rear panel member conforming to the surface of the support and fastening member for mounting the housing member to the support.

13. The martial arts practice device of claim 1 wherein the first joining member comprises a cartridge member captured in the receiving portion on the housing member and connected to the resilient member.

14. The martial arts practice device of claim 13 wherein the first joining member further comprises a collar member fixed to the cartridge member and extending beyond the housing member toward the striking member, the collar member having a through chamber portion that retains at least a portion of the resilient member.

15. The martial arts practice device of claim 1 wherein the first joining member is a pin member, the receiving portion on the housing member having at least one receiving hole capturing the pin member.

16. The martial arts practice device of claim 1 further comprising at least one interchanging joint member, the joint member and the interchanging joint member being resilient and different in tension.

17. The martial arts practice device of claim 3 wherein the cover member is made of 65 durometer natural black rubber.

18. The martial arts practice device of claim 1 wherein the resilient member is cylindrical, and the end portions of the resilient member are tapered.

19. The martial arts practice device of claim 1 wherein the joint member is removably connected between the housing member and the striking member.

* * * * *